US006752287B1

(12) United States Patent
Lin

(10) Patent No.: US 6,752,287 B1
(45) Date of Patent: Jun. 22, 2004

(54) SPLASH-PROOF BEVERAGE LID SLIDE CLOSURE

(76) Inventor: Shin-Shuoh Lin, 27022 Falling Leaf Dr., Laguna Hills, CA (US) 92653

( * ) Notice: Subject to any disclaimer, the term of this patent is extended or adjusted under 35 U.S.C. 154(b) by 0 days.

(21) Appl. No.: 10/408,792

(22) Filed: Apr. 8, 2003

(51) Int. Cl.[7] ..... B65D 51/18

(52) U.S. Cl. ..... 220/254.9; 220/354.1; 220/719

(58) Field of Search ..... 220/254.9, 719, 220/253, 713, 714, 710.5, 717, 718, 259.4, 354.1, 354.2, 354.4, FOR 183–185; 215/DIG. 7, 378; D9/447

(56) References Cited

U.S. PATENT DOCUMENTS

| | | | | | |
|---|---|---|---|---|---|
| 2,304,214 | A | * | 12/1942 | Straub | 222/542 |
| 4,170,724 | A | * | 10/1979 | Waterbury | 220/270 |
| 5,018,636 | A | | 5/1991 | Ross | |
| 5,102,000 | A | | 4/1992 | Feldman, III | |
| 5,249,703 | A | | 10/1993 | Karp | |
| 5,368,186 | A | | 11/1994 | Yeh | |
| 5,477,979 | A | | 12/1995 | Goessling et al. | |
| 5,531,353 | A | | 7/1996 | Ward et al. | |
| 5,680,951 | A | * | 10/1997 | Feltman et al. | 220/253 |
| D406,006 | S | | 2/1999 | Hatsumoto et al. | |
| 5,938,062 | A | * | 8/1999 | Paramski | 220/254.9 |
| 6,098,834 | A | | 8/2000 | Hatsumoto et al. | |
| 6,354,454 | B1 | * | 3/2002 | Wong | 220/345.1 |
| 6,439,442 | B1 | * | 8/2002 | Markert et al. | 222/547 |

* cited by examiner

*Primary Examiner*—Lien Ngo
(74) *Attorney, Agent, or Firm*—Gordon K. Anderson

(57) ABSTRACT

A splash-proof beverage lid closure (20) for a travel mug has a lid member (30) in the form of a peripheral rim with a raised pouring lip (32) on one side and a disengagement tab (34) on the other. A circular sidewall (36) integrally distends from the lid member, and an inclined recessed disc (44) is integrally formed within a lower portion of this circular sidewall. The disc has a liquid egress aperture (46), an alignment slot (48), a pair of parallel snap-in clasp slots (50) and a disc vent hole (52) therein. A blocking barrier slide (58), complete with an upright thumb actuating bar (60) on the upper portion of the slide, includes an alignment tab (62) along with a pair of extended snap-in clasps (64) on a bottom portion of the slide and a slide vent hole (68) therethrougth. The slide snap-in clasps captivate the slide onto the disc. When the slide is manually urged away from the liquid egress aperture the slide vent hole aligns with the disc vent hole, an unobstructed flow of liquid is permitted through the aperture, and, when the blocking barrier slide is slid over the egress aperture the vent holes are misaligned and closed, forming a splash-proof closure preventing liquid from sloshing from the lid closure during transportation and limiting spillage when a travel mug having the lid closure attached is inadvertently tipped over.

16 Claims, 5 Drawing Sheets

SPLASH-PROOF BEVERAGE LID SLIDE CLOSURE

TECHNICAL FIELD

The present invention relates to beverage lid closures in general. More specifically the invention is for a thermoplastic closure for beverages that has a barrier slide that linearly slides over and covers an opening in the lid to prevent splashing of the liquid contents.

BACKGROUND ART

Previously, many types of beverage lids have been used in endeavoring to provide an effective means to cover liquid containing cups, mugs and tumblers. In order to provide added utility, the lid normally contains an opening allowing a person to drink out of directly or to insert a straw. In the past some prior art used separate stoppers to plug the hole, others utilized hinged plugs, rotating lid sections, removable plugs etc.

The prior art listed below did not disclose patents that possess any of the novelty of the instant invention; however the following U.S. Patents are considered related:

| U.S. Pat. No. | Inventor | Issue Date |
|---|---|---|
| 5,018,636 | Ross | May 28, 1991 |
| 5,102,000 | Feldman.III | Apr. 7, 1992 |
| 5,249,703 | Karp | Oct. 5, 1993 |
| 5,368,186 | Yeh | Nov. 29, 1994 |
| 5,477,979 | Goessling et al. | Dec. 26, 1995 |
| 5,531,353 | Ward et al. | Jul. 2, 1996 |
| 6,098,834 | Hatsumoto et al. | Aug. 8, 2000 |
| Des. 406,006 | Hatsumoto et al. | Feb. 23, 1999 |

Ross in U.S. Pat. No. 5,018,636 teaches a safety mug for liquids with an improved top which permits the liquid to retain its temperature while it is in the mug and further secure the liquid if the mug is bumped. The mug utilizes a single drink hole covered with a sealing member, or lid, rotatably retained by an internal shelf. The lid is hemispherical in shape and extends into and across the mug. The shape of the top includes a continuous groove or bump on the inside which forces any liquid to take a circuitous route before exiting the mug, creating a barrier, such that the liquid will not spill out should the container be accidentally bumped or jarred.

U.S. Pat. No. 5,102,000 issued to Feldman.III is for a drink mug that has an inwardly projecting ring, with spaced notches, that contain lid latch members carried on the lid which pass through vertical passages in the body. Flexible fingers connect the latch to the lid with two vertical passages opposite each other and two notches at 90 degrees to the vertical passages. The lid contains an opening for drinking as shown and described.

Karp in U.S. Pat. No. 5,249,703 discloses a travel mug and lid combination. A cylindrical well in the lid has a vertical dividing wall so that the lid may be readily rotated by hand. Diametrically opposed notches in the lid align with gaps in the annular lip allowing a person to drink from the otherwise sealed container.

Yeh in U.S. Pat. No. 5,368,186 teaches a safety lid for a drinking mug. The lid has a circumferential mouth and internal surface also a central core with a circular sidewall attached to its bottom surface. A circular ring is attached to the circular side wall of the central core and an outer surface is adapted to frictionally engage the internal surface to the mouth of the ring. The lid has a semi-circular gap on the edge of the disk. The central core has a curved channel that is similarly shaped. When the two elements are rotated into alignment a passage way is created for drinking from the mug.

U.S. Pat. No. 5,477,979 issued to Goessling et al. is for a beverage mug with a removable closure. A sipping liner is utilized that lies within the mouth of the vessel below the rim preventing the beverage contained within from splashing out of the mug. The lid fits over and engages the liner opening; however, the liner may detached from the lid and installed separately in the mouth of the vessel. A sipping aperture and vent are placed in the liner for drinking from the mug.

Ward et al.in U.S. Pat. No. 5,531,353 discloses a drinking cup with a removable lid that is disconnected and placed onto a storage portion of the base for stability of the cup and to add utility to the invention.

Finally Hatsumoto et al. in utility U.S. Pat. No. 6,098,834 and design U.S. Pat. No. D406,006 teaches a drinking receptacle cover that utilizes a slant cover plate with a valve assembly for opening and closing a spout formed at a lowest portion of the slanted plate. The valve assembly is pivotally supported by brackets protruding from the bottom surface of the cover plate and a push rod penetrates the opening formed in the rim of the plate.

DISCLOSURE OF THE INVENTION

In the past few decades the use of travel mugs for coffee and soft drinks has become extremely popular and a myriad of types and styles have been developed and marketed to fill this need. The stainless steel double walled vacuum insulated travel mugs in particular, have been well accepted, however, the continued use in motor vehicles has created a problem since the liquid within the vessel is subject to spillage either by sloshing caused by sudden braking, centrifugal force on turns or fast starts.

It is therefore a primary object of the invention to utilize a lid closure on the travel mug that has a closure slide that is in intimate contact with the lid and easily slides over the liquid opening when not in use, providing a splash proof covering that is attached to the lid to prevent any unwanted liquid loss.

An important object of the invention is the easy removable of the closure slide for sanitary cleaning. This feature is lacking in most prior art that is attached to the lid itself as any apparatus that requires rotation or linear movement is normally attached in a permanent manner. The invention includes not only a removable closure slide but the lid itself has both a smooth unobstructed top and bottom surface that is simple to clean. Removal of the closure slide is easy and intuitively obvious which is accomplished by simply pinching two snap-in clasps together and in so doing this action disengages the clasps and simultaneously forces the closure slide from the slots. After cleaning, the closure slide is replaced by simply snapping the clasps back into place in the slots.

Another object of the invention is that the closure slide locks in the open position to preclude closing by gravity when the travel mug is tipped up for drinking. The snap-in clasps expand into the slots that are wider on one end and effectively lock the closure slide in the open position however not so tightly as to disallow closing when required.

Still another object of the invention is that both the closure slide and disc contain a vent opening that interface with each other when aligned and become asymmetrical when slid apart preventing the passage of air. The vent arrangement permits a smooth even flow of liquid from the mug and yet prevents leakage when closed.

Yet another object of the invention is that it is intuitively obvious to operate since the closure disc has an upright raised thumb actuating bar formed on the center of the top. Its mere appearance is indicative of its purpose which is a cover or stopper over the opening.

A further object of the invention is the modern streamlined shape of the closure slide which matches the decor of the container and is visually attractive.

A final object of the invention is that it is cost effective to manufacture as only one movable element is required and its assembly is extremely simple and quick to accomplish. Since there are only three separate parts, a lid member interfacing with a closure slide, both easily injection molded of thermoplastic, and an O-ring type sealing ring, also molded. Once the cost of the tooling is amortized the piece price becomes very economical.

These and other objects and advantages of the present invention will become apparent from the subsequent detailed description of the preferred embodiment and the appended claims taken in conjunction with the accompanying drawings.

BRIEF DESCRIPTION OF THE DRAWINGS

FIG. 23 is a left side elevation view of the blocking barrier slide alone in its preferred embodiment with an enlarged view of one of the.

BEST MODE FOR CARRYING OUT THE INVENTION

Figure 1:
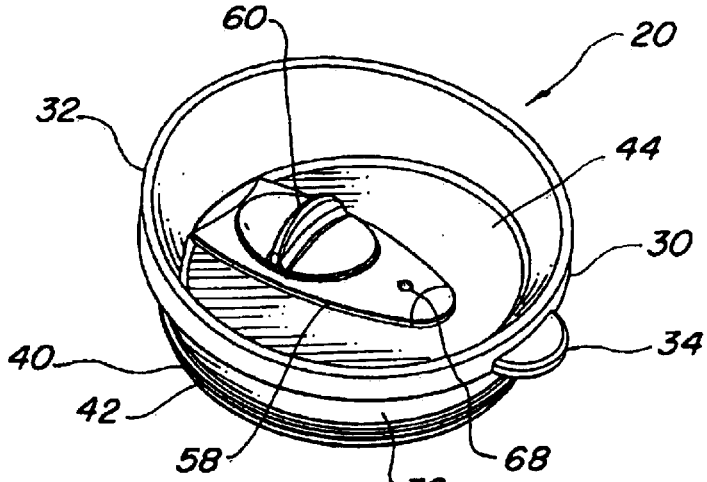
FIG. 1 is a partial isometric view of the splash-proof beverage lid closure in its preferred embodiment.
Figure 2:
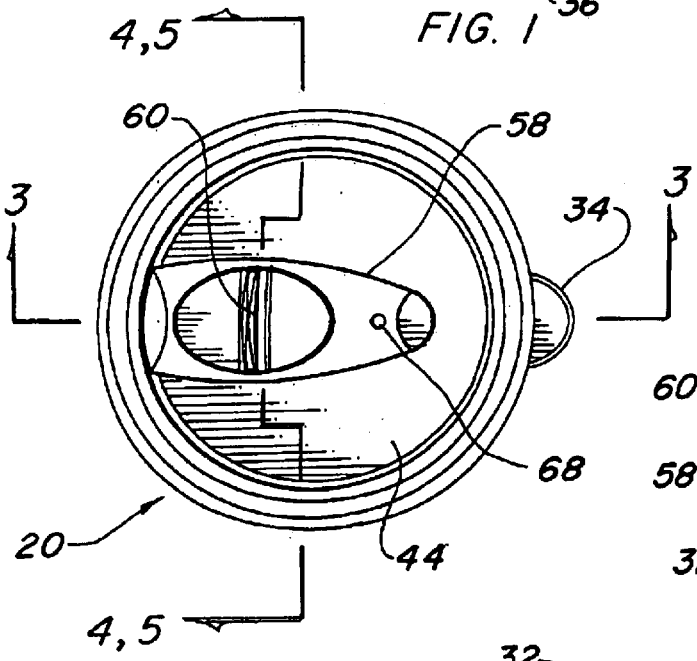
FIG. 2 is a plan view of the preferred embodiment.

The best mode for carrying out the invention is presented in terms of a preferred embodiment. This preferred embodiment of the splash-proof beverage lid closure 20 is shown in FIGS. 1 thorough 29. It should be noted that the invention is primarily designed to fit onto a stainless steel double walled vacuum insulated travel mug however any type of liquid containing vessel would be applicable for its utility including insulated and non insulated cups, tumblers, glasses, coffee mugs, tankers, schooners or any round liquid containing vessels. The preferred embodiment is comprised of a lid member 30, shown in FIGS. 1–19, which includes a peripheral rim with a raised pouring lip 32 on a first side and a protruding disengagement tab 34 on a second side, opposite said first side. The raised pouring lip 32 is configured to be comfortable to drink out of, providing a smooth radial surface to receive liquid from within the mug. The disengagement tab 34 is a semi-circular shaped protrusion about the size of ones finger that may be manually pushed up to lift the lid member 30 from the travel mug for removal.

Figure 3:
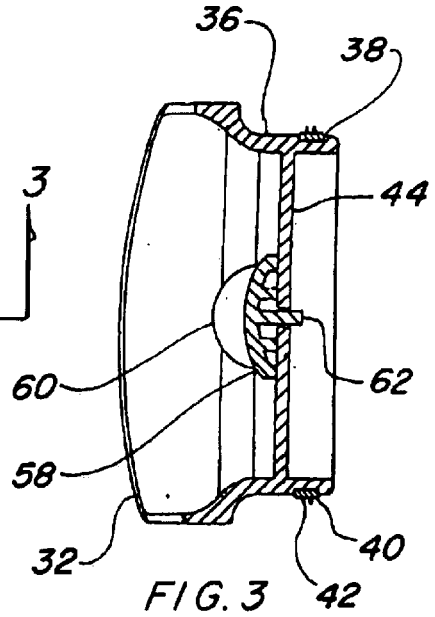
FIG. 3 is a cross sectional view taken along lines 3—3 of FIG. 2.
Figure 4:
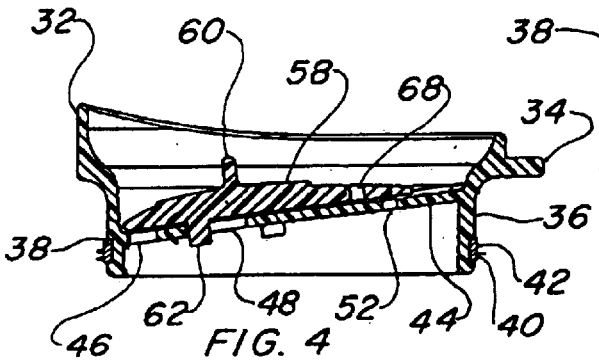
FIG. 4 is a cross sectional view taken along lines 4—4 of FIG. 2 with the closure blocking barrier slide illustrated in the closed position.
Figure 5:
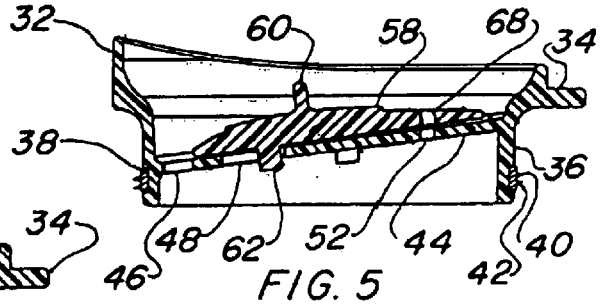
FIG. 5 is a cross sectional view taken along lines 5—5 of FIG. 2 with the closure blocking barrier slide illustrated in the open position.
Figure 6:
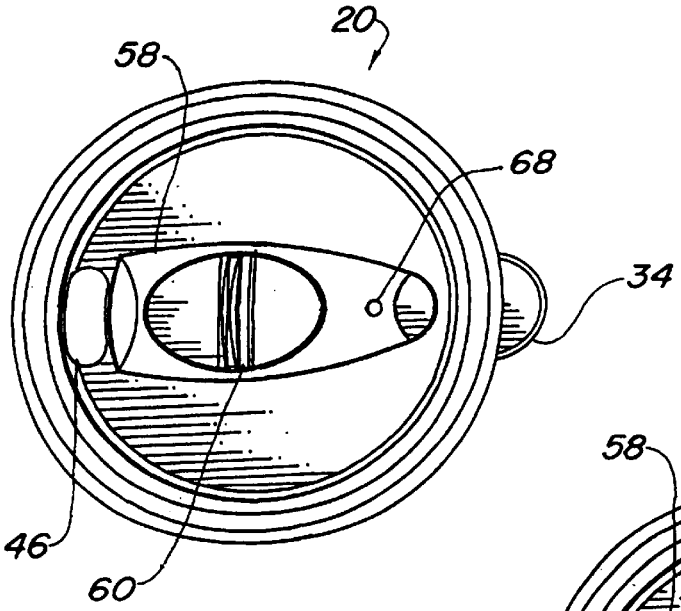
FIG. 6 is a plan view of the preferred embodiment illustrating the closure blocking barrier slide in the open position.
Figure 7:
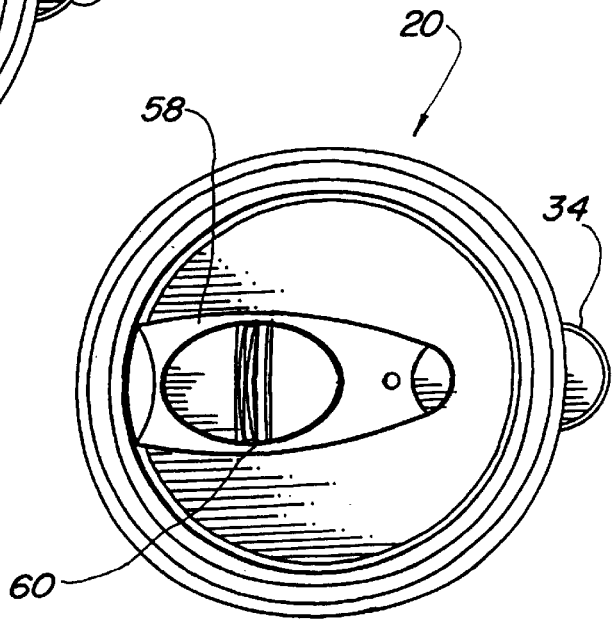
FIG. 7 is a plan view of the preferred embodiment illustrating the closure blocking barrier slide in the closed position.

A circular sidewall 36 integrally distends from the lid member 30, and contains means for sealing between the travel mug and the lid closure 20 in the form of a peripheral sealing ring groove 38 made within the sidewalls circumferential outside surface. A resilient sealing ring 40 is disposed within the sealing ring groove 38, as shown in FIGS. 3–5. This sealing ring 40 is illustrated alone in FIG. 12 and is of the o-ring type of gasket seal well known in the art. It is preferred to utilize a pair of integral thin extending chevrons 42 projecting from the outer surface of the sealing ring 40 that deform when the lid closure 20 is installed on a mug, creating a positive liquid seal and yet permit the lid to be easily removed.

Figure 19:
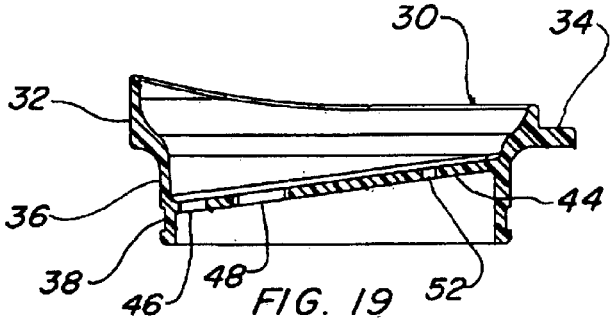
FIG. 19 is a cross sectional view taken along lines 19—19 of FIG. 15 illustrating the liquid egress aperture, alignment slot and vent opening.

An inclined recessed disc 44 is integrally formed within a lower portion of the circular sidewall 36 on a first side and with the interface of the lip 32 and the sidewall 36 on an opposite second side, as shown in cross section in FIGS. 4, 5 and 19. The disc 44 is flat and has the same thickness throughout however it is slanted downward toward the pouring lip 32 to make drinking from the travel mug easier. The recessed disc 44 includes a liquid egress aperture 46, positioned adjoining a juncture between the circular sidewall 36 and the first side of the inclined recessed disc 44 providing an unobstructed flow path for liquid when poured from the mug. This aperture 46 is preferably oval or kidney shaped and is approximately 0.60 inches (1.52 cm) long by 0.30 inches (0.76 cm) wide in its optimum configuration.

There are four additional openings in the recessed disc 44 which include an alignment slot 48, a pair of parallel snap-in clasp slots 50 and a disc vent hole 52. The alignment slot 48 is located on the datum centerline of the disc 44 adjacent to the aperture 46 as shown best in FIGS. 9–11 and 15. The snap-in clasp slots 50 are almost centrally located and correspond in alignment with the slot 48. The slots 50 are spread apart approximately 0.263 inches (0.67 cm) and each have a narrow end 54 facing the first side of the disc 44 and a wide end 56 facing the second, or opposite, side of the disc 44 toward the disengagement tab 34. It has been found that the slots 50 function best when the slots wide ends 56 are at least 30 percent wider than the narrow ends 54. The vent hole 52 is approximately 0.131 inches (0.33 cm) in diameter which is sufficient to introduce an adequate volume of air inside of the mug when a person is drinking the liquid contents. The hole 52 is also on the datum centerline of the disc 44 but is adjacent to the disengagement tab 34 as shown.

As described above the lid member 30, the circular sidewall 36 and the disc 44 are integrally formed together creating the completed lid structure as shown alone in FIGS. 12–19. The entire lid structure, including its collective elements 30, 36 and 44, are preferably made of injection molded thermoplastic material such as polycarbonate, polyethylene, polyamide, polystyrene, polypropylene, polysulfone, polyurethane, ethylene-vinyl-acetate or the like.

The third separate element of the invention is shown by itself in FIGS. 20–29 and consists of a blocking barrier slide 58, also made of the same material as the lid structure. The blocking barrier slide 58 is preferably formed in a parabolic shape with one end truncated, and an upright thumb actuating bar 60 integrally formed on an upper portion of the slide in a partial elliptical shape. On the bottom portion of the slide 58 an alignment tab 62 is integrally formed, illustrated best in FIGS. 22, 23 and 25–27. This tab 62 is slightly narrower than the alignment slot 48 permitting the slide 58 to be inserted therein thereby orienting the slide 58 in its linear travel.

A pair of extended snap-in clasps 64 also extends from a bottom portion of the slide 58, illustrated in FIGS. 22, 23 and 25, 26 and 28. Each of the snap-in clasps 64 have a truncated angled distal end forming an outwardly extending sear 66 located essentially the same distance from the bottom portion of the slide 58 as the width of the disc 44, creating a tight sliding fit when positioned therebetween. The snap-in clasps truncated angled distal end sear 66, has a sear width of from 0.020 inch (0.05 cm) to 0.040 inch (0.10 cm) as depicted in the enlarged view of FIG. 23 designated with the letter "a".

Figure 20:
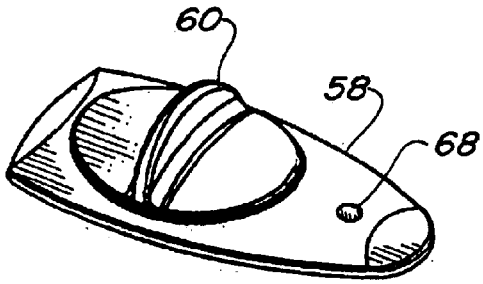
FIG. 20 is a partial isometric view of the top of the blocking barrier slide completely removed from the invention for clarity.
Figure 21:
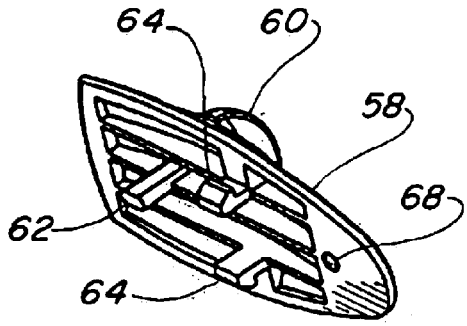
FIG. 21 is a partial isometric view of the bottom of the blocking barrier slide completely removed from the invention for clarity.
Figure 22:
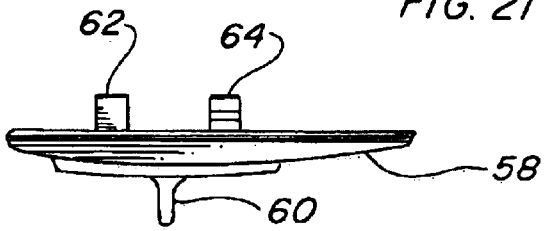
FIG. 22 is an upper side elevation view of the blocking barrier slide alone in its preferred embodiment.
Figure 23:
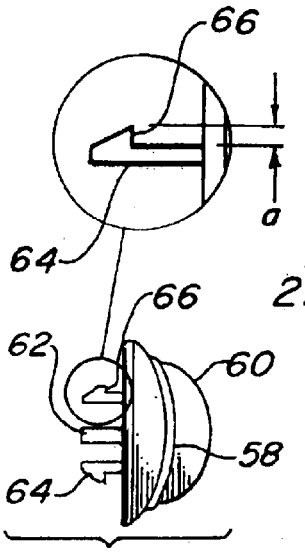
Figure 24:
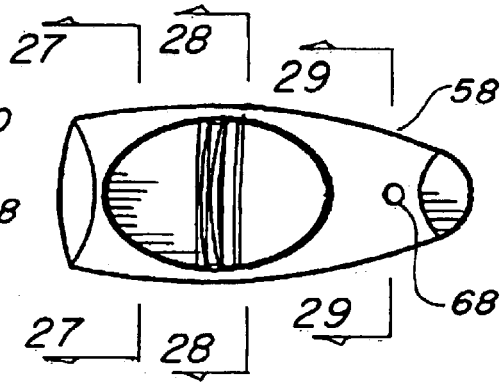
FIG. 24 is a top plan view of the preferred embodiment of the blocking barrier slide alone in its preferred embodiment.
Figure 25:
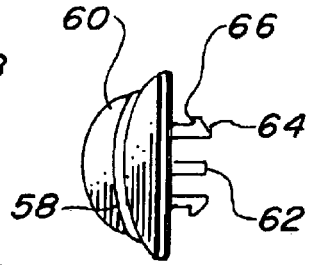
FIG. 25 is a right side elevation view of the blocking barrier alone in its preferred embodiment.
Figure 26:
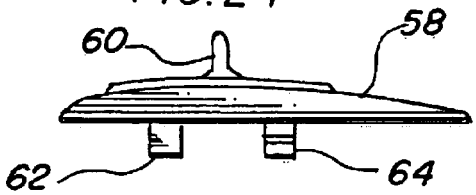
FIG. 26 is a lower side elevation view of the blocking barrier slide alone in its preferred embodiment.
Figure 27:
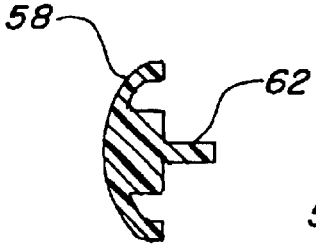
FIG. 27 is a cross sectional view taken along lines 27—27 of FIG. 24 illustrating the alignment tab.
Figure 28:
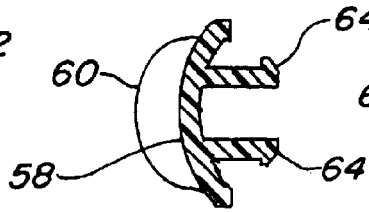
FIG. 28 is a cross sectional view taken along lines 28—28 of FIG. 24 illustrating the snap-in clasps.
Figure 29:
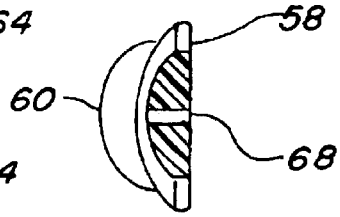
FIG. 29 is a cross sectional view taken along lines 29—29 of FIG. 24 illustrating the slide vent hole.

A slide vent hole 68 is formed completely through the blocking barrier slide 58 as illustrated in FIGS. 20, 24 and 29. This slide vent hole 68 is the same size as the disc vent hole 52 and when the slide 58 is slid open the two holes align and prove a through opening to permit air to be introduced into the interior of the travel mug to displace the liquid volume removed when the a person drinks from the mug.

In assembly, the slide snap-in clasps 64 and the alignment tab 62 are simultaneously snapped into the clasp slots 50 and alignment slot 48 thereby captivating the slide onto the disc 44 as the clasps 64 expand and each sear 66 engages the bottom surface of the disc 44. When the slide 58 is manually urged away from the liquid egress aperture 46 the slide vent hole 68 aligns with the disc vent hole 52 an unobstructed flow of liquid is permitted through the aperture 46. When the blocking barrier slide 58 is slid over and covers the egress aperture 46, the vent holes 52 and 68 are misaligned and therefore closed forming a splash-proof closure that prevents liquid from sloshing from the lid closure 20 during transportation and limiting spillage when the travel mug, having the lid closure attached, is inadvertently tipped over.

It will be noted that the blocking barrier slide 58 locks into an open position when manually slid wide open exposing the liquid egress aperture 46. This feature prevents inadvertent closure when the travel mug is tipped up, as in the act of drinking from the travel mug to which the closure 20 is attached. This feature is accomplished since the extended snap-in clasps 64 have a wider breadth than the parallel slots 50. When the extended snap-in clasps 64 are forced into the slots 50 the clasps 64 are squeezed together and snap into the slots 50 holding the barrier slide 58 in place by the interface with the sears 66 onto the disc 44, while permitting it to slide forward and rearward. When the closure slide 58 is in an open position the clasps 64 expand into the wide end 56 of the slots 50 locking the slide 58 open.

Figure 8:
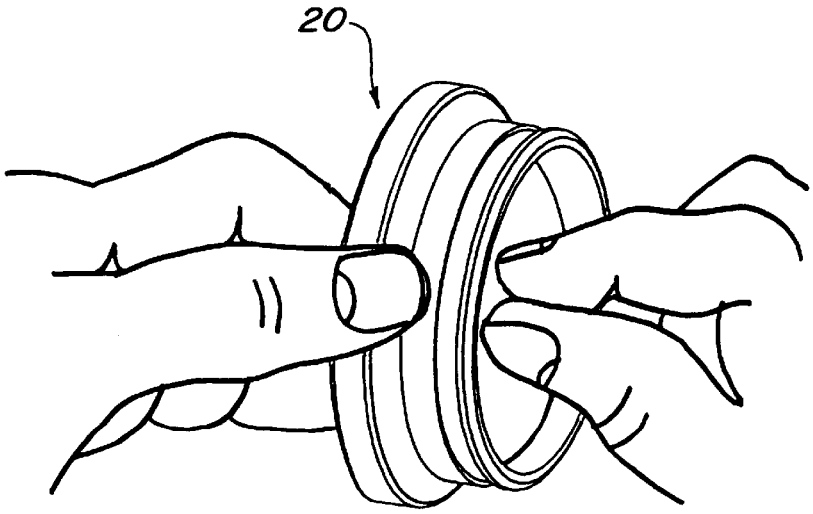
FIG. 8 is a partial isometric view of the splash-proof beverage lid blocking barrier closure in the preferred embodiment, illustrating the method of manually removing the closure slide from the lid by pinching the snap-in clasps together with ones thumb and forefinger.
Figure 9:
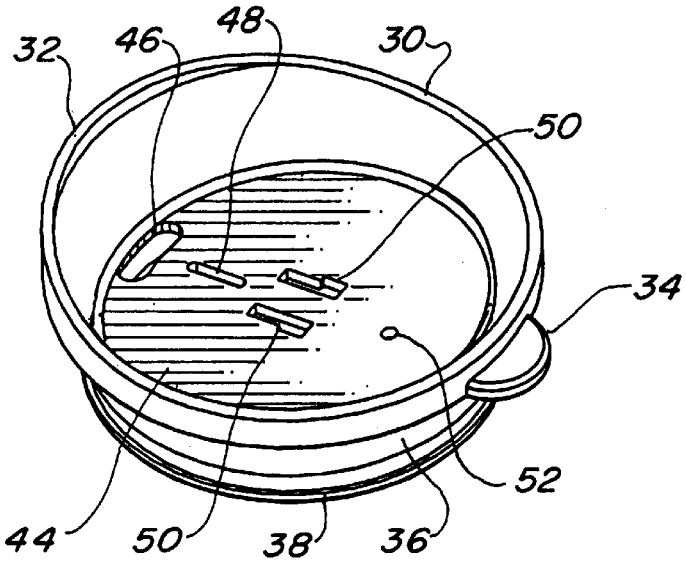
FIG. 9 is a partial isometric top view of the splash-proof beverage lid structure in the preferred embodiment, shown removed from the invention for clarity.
Figure 10:
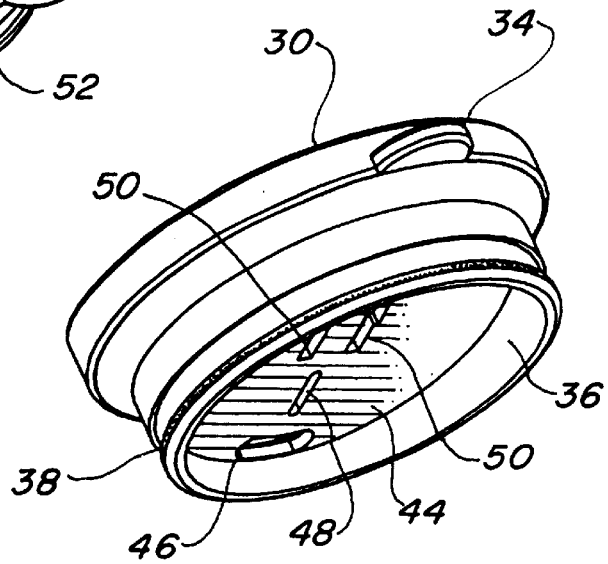
FIG. 10 is a partial isometric top view of the splash-proof beverage lid structure in the preferred embodiment, shown removed from the invention for clarity.
Figure 11:
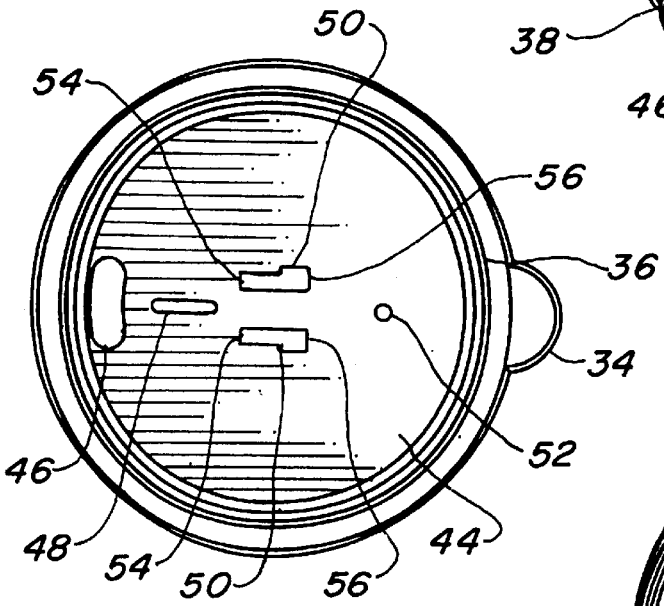
FIG. 11 bottom view of the splash-proof beverage lid structure in the preferred embodiment, shown removed from the invention for clarity.
Figure 12:
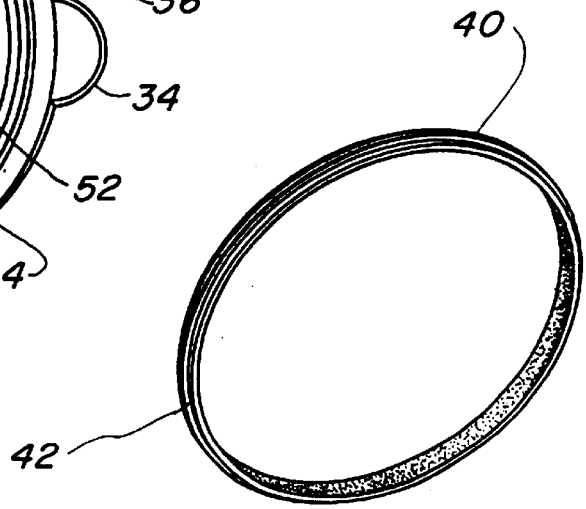
FIG. 12 is a partial isometric top view of the resilient sealing ring in the preferred embodiment, shown removed from the invention for clarity.
Figure 13:
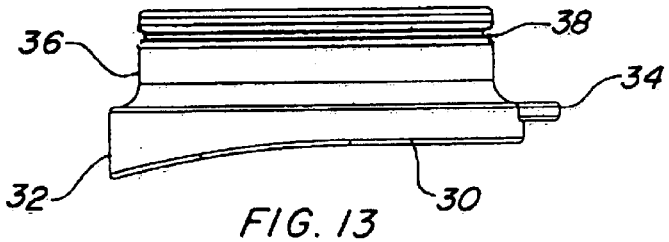
FIG. 13 is an upper side elevation view of the lid structure alone, in its preferred embodiment.
Figure 14:
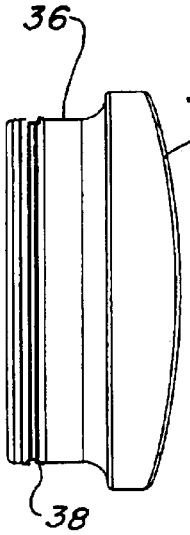
FIG. 14 is a left side elevation view of the lid structure alone, in its preferred embodiment.
Figure 15:
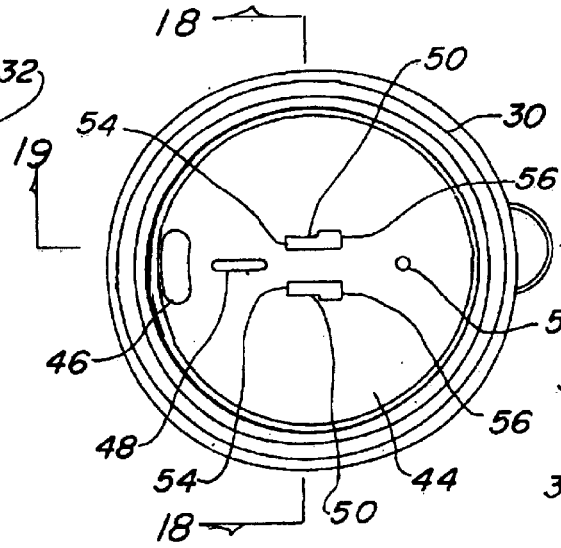
FIG. 15 is a top plan view of the preferred embodiment of the lid structure alone, in its preferred embodiment.
Figure 16:
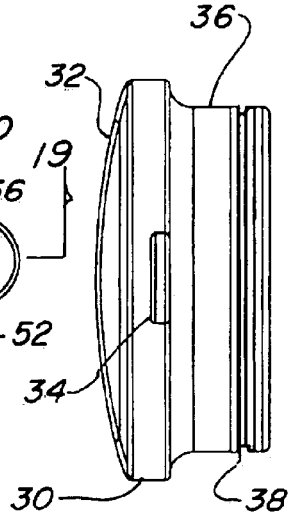
FIG. 16 is a right side elevation view of the lid structure alone, in its preferred embodiment.
Figure 17:
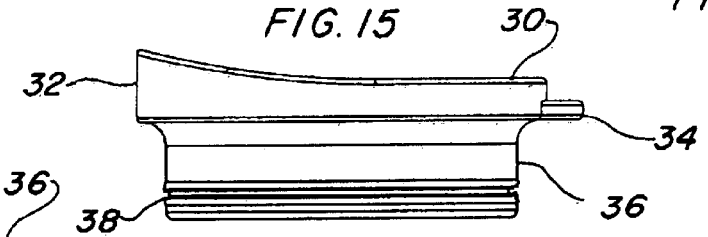
FIG. 17 is a lower side elevation view of the lid structure alone, in its preferred embodiment.
Figure 18:
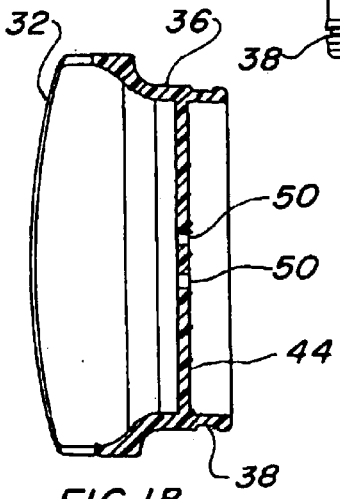
FIG. 18 is a cross sectional view taken along lines 18—18 of FIG. 15 illustrating the pair of the snap-in clasp slots.

The blocking barrier slide 58 is removed for cleaning from an assembled closure 20 by manually pinching the snap-in clasps 64 together from the bottom side of the disc 44 as shown pictorially in FIG. 8.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

Element Designation (For convenience of the Examiner, not part of the specification)

20 lid closure (assembly)
30 lid member
32 pouring lip
34 disengagement tab
36 circular sidewall
38 sealing ring groove
40 sealing ring
42 extending chevrons (on 40)
44 disc
46 liquid egress aperture
48 alignment slot
50 snap-in clasp slots
52 disc vent hole
54 narrow end (of 50)
56 wide end (of 50)
58 blocking barrier slide
60 thumb actuating bar
62 alignment tab
64 snap-in clasps
66 sear
68 slide vent hole

What is claimed is:

1. A splash-proof beverage lid closure for a travel mug comprising, a lid member having a peripheral rim with a raised pouring lip on a first side and a protruding disengagement tab on a second side opposite said first side, a circular sidewall integrally distending from said lid member, wherein said circular sidewall includes means for sealing between a travel mug and the lid closure, an inclined recessed disc integrally formed within a lower portion of the circular sidewall on a first side and with the interface of the lip and the sidewall on an opposite second side, said recessed disc having a liquid egress aperture, an alignment slot, a pair of parallel snap-in clasp slots and a disc vent hole therein, and a blocking barrier slide having an upright thumb actuating bar on an upper portion of the slide, an alignment tab along with a pair of extended snap-in clasps on a bottom portion of the slide and a slide vent hole therethrougth, wherein said slide snap-in clasps and the alignment tab snap into the clasp slots and alignment slot, simultaneously captivating the slide onto the disc, when the slide is manually urged away from the liquid egress aperture the slide vent hole aligns with the disc vent hole, an unobstructed flow of liquid is permitted through the aperture, and, when the blocking barrier slide is slid over the egress aperture the vent holes are misaligned and closed, forming a splash-proof closure preventing liquid from sloshing from the lid closure during transportation and limiting spillage when a travel mug having the lid closure attached is inadvertently tipped over.

2. The splash-proof beverage lid closure as recited in claim 1 further comprises an injection molded thermoplastic material forming both the lid member and the blocking barrier slide.

3. The splash-proof beverage lid closure as recited in claim 2 wherein said injection molded thermoplastic material is selected from the group consisting of polycarbonate, polyethylene, polyamide, polystyrene, polypropylene, polysulfone, polyurethane, and ethylene-vinyl-acetate.

4. The splash-proof beverage lid closure as recited in claim 1 wherein said circular sidewall further having a peripheral sealing ring groove within a circumferential outside surface.

5. The splash-proof beverage lid closure as recited in claim 4 wherein said means for sealing between a travel mug and the lid closure further comprising, a resilient sealing ring disposed within said sealing ring groove.

6. The splash-proof beverage lid closure as recited in claim 1 wherein said egress aperture is positioned adjoining a juncture between said circular sidewall and said first side of the inclined recessed disc providing an unobstructed flowpath.

7. The splash-proof beverage lid closure as recited in claim 1 further comprising, said blocking barrier slide locks into an open position when manually slid wide open exposing the liquid egress aperture preventing inadvertent closure when tipped up when in the act of drinking from the travel mug to which the closure is attached.

8. The splash-proof beverage lid closure as recited in claim 7 wherein the slide locks into an open position further comprises, said extended snap-in clasps having a wider breadth than the parallel slots and said pair of parallel snap-in clasp slots having a narrow end facing said first side of the disc and a wide end facing said second side of the disc such that when the extended snap-in clasps are forced into the slots the clasps are squeezed together and snap into the slots holding the barrier slide in place and yet permit sliding forward and rearward and when the closure slide is in an open position the clasps expand into the wide end of the slots locking the slide open.

9. The splash-proof beverage lid closure as recited in claim 8 wherein the slots wide ends are at least 30 percent wider than the narrow ends.

10. The splash-proof beverage lid closure as recited in claim 8 wherein said extended snap-in clasps further comprises a truncated angled distal end forming an outwardly extending sear located essentially the same as the disc width creating a tight sliding fit therebetween.

11. The splash-proof beverage lid closure as recited in claim 10 wherein said extended snap-in clasps truncated angled distal end sear further comprises a sear width of from 0.020 inch (0.05 cm) to 0.040 inch (0.10 cm).

12. The splash-proof beverage lid closure as recited in claim 1 wherein said blocking barrier slide further having a parabolic shape with one end truncated.

13. The splash-proof beverage lid closure as recited in claim 1 wherein said upright thumb actuating bar further having a partial elliptical shape.

14. The splash-proof beverage lid closure as recited in claim 1 further comprising, said blocking barrier slide is removed from an assembled closure by manually pinching the snap-in clasps together from the disc bottom side.

15. A splash-proof beverage lid closure for a mug comprising, a lid member having a rim with a raised pouring lip and a disengagement tab, a circular sidewall formed with said lid member, a disc formed within the circular sidewall, said disc having a liquid egress aperture, an alignment slot, a pair of parallel snap-in clasp slots and a disc vent hole therein, and a blocking barrier slide having an alignment tab, a pair of extended snap-in clasps and a slide vent hole therethrougth, wherein said slide snap-in clasps snaps into the clasp slots and the alignment tab simultaneously penetrate the alignment slot, captivating the slide onto the disc, when the slide is manually urged away from the liquid egress aperture the slide vent hole aligns with the disc vent hole, a flow of liquid is permitting through the aperture and when the blocking barrier slide is slid over the egress aperture the vent holes are misaligned forming a splash-proof closure preventing liquid from leaking, during transportation and limiting spillage when the vessel, having the lid closure attached, is completely tipped over.

16. A splash-proof beverage lid closure for a mug comprising, a lid member having a rim including a raised pouring lip, a circular sidewall integral with said lid member, a disc integral with the circular sidewall, said disc having a liquid egress aperture, an alignment slot, a pair of parallel snap-in clasp slots and a disc vent hole therein, and a slide having an alignment tab, a pair of extended snap-in clasps and a slide vent hole therethrougth, wherein said snap-in clasps snaps into the clasp slots and the alignment tab simultaneously penetrate the alignment slot, captivating the slide onto the disc, when the slide is manually urged away from the liquid egress aperture a flow of liquid is permitting through the aperture.

* * * * *